US011873138B2

(12) United States Patent
Epstein et al.

(10) Patent No.: US 11,873,138 B2
(45) Date of Patent: Jan. 16, 2024

(54) TAMPER EVIDENT DELIVERY PACKAGING

(71) Applicant: Safeplate LLC, Nassau, DE (US)

(72) Inventors: Robert Allen Epstein, Henderson, NV (US); Kumar Abhishek, Bear, DE (US); Walter Vittitoe, New Brunswick, NJ (US); Tia Vittitoe, New Brunswick, NJ (US)

( * ) Notice: Subject to any disclaimer, the term of this patent is extended or adjusted under 35 U.S.C. 154(b) by 368 days.

(21) Appl. No.: 17/249,818

(22) Filed: Mar. 15, 2021

(65) Prior Publication Data

US 2021/0284395 A1 Sep. 16, 2021

Related U.S. Application Data

(60) Provisional application No. 62/989,748, filed on Mar. 15, 2020.

(51) Int. Cl.
*B65D 33/25* (2006.01)
*B65D 33/10* (2006.01)

(52) U.S. Cl.
CPC ..... *B65D 33/2516* (2013.01); *B65D 33/105* (2013.01); *B65D 33/2541* (2013.01); *B65D 33/2585* (2020.05); *B65D 33/259* (2020.05)

(58) Field of Classification Search
CPC .... B65D 33/004; B65D 33/04; B65D 33/255; B65D 33/2533; B65D 33/252; B65D 33/2585; B65D 33/2589; B65D 33/2541; B65D 33/105
See application file for complete search history.

(56) References Cited

U.S. PATENT DOCUMENTS

| | | | | |
|---|---|---|---|---|
| 6,527,444 | B1 * | 3/2003 | Buchman | B65D 33/2516 53/469 |
| 9,607,280 | B2 | 3/2017 | Gazdzinski et al. | |
| 9,892,379 | B1 | 2/2018 | Danyluk et al. | |
| 10,039,401 | B1 | 8/2018 | Romanucci | |
| 10,235,651 | B2 | 3/2019 | Winkle et al. | |
| 10,492,636 | B2 | 12/2019 | Ruben | |
| 10,614,408 | B2 | 4/2020 | Lau et al. | |

(Continued)

FOREIGN PATENT DOCUMENTS

WO WO-2012145810 A1 * 11/2012 ..... B65D 33/004

*Primary Examiner* — Anthony D Stashick
*Assistant Examiner* — Raven Collins
(74) *Attorney, Agent, or Firm* — Dunlap Bennett & Ludwig, PLLC

(57) ABSTRACT

A tamper evident package for secure delivery of a product is disclosed. The tamper evident packaging includes a plurality of sidewalls having a closure providing access to an interior compartment of the packaging. The closure includes a closure slide that urges a closure seal into cooperative engagement during movement of the closure slide. Cooperating ratchet teeth are provided in the closure slide and at a closed end of the closure to retain the closure slide in a locked position. The closure slide includes a land for carrying a unique identifier code. The unique identifier code is visible through a window in the closure when the closure slide is in the locked position. The tamper evident packaging may be used with a product delivery service where the unique identifier code is used to identify an order through a packing of the product through receipt of the product by the customer.

10 Claims, 9 Drawing Sheets

(56) References Cited

U.S. PATENT DOCUMENTS

| | | | |
|---|---|---|---|
| 2002/0013906 | A1 | 1/2002 | Wallach et al. |
| 2002/0133361 | A1 | 9/2002 | Kindell et al. |
| 2005/0165612 | A1 | 7/2005 | Van Rysselberghe |
| 2010/0183199 | A1 | 7/2010 | Smith et al. |
| 2012/0158606 | A1 | 6/2012 | Moudy |
| 2013/0073312 | A1 | 3/2013 | Thompson et al. |
| 2014/0370167 | A1 | 12/2014 | Garden |
| 2016/0292634 | A1 | 10/2016 | Mehring et al. |
| 2017/0053232 | A1 | 2/2017 | Wilkinson |
| 2017/0261237 | A1 | 9/2017 | High et al. |
| 2017/0293883 | A1 | 10/2017 | Li et al. |
| 2018/0053365 | A1 | 2/2018 | Bode et al. |
| 2018/0240065 | A1 | 8/2018 | Hilsley et al. |
| 2019/0039751 | A1 | 2/2019 | Janssen |
| 2019/0043298 | A1 | 2/2019 | Moudy |
| 2019/0049988 | A1 | 2/2019 | Meij |
| 2019/0087775 | A1 | 3/2019 | Buehre |
| 2019/0112119 | A1 | 4/2019 | Alexander et al. |
| 2019/0130348 | A1 | 5/2019 | Mellado et al. |
| 2019/0354928 | A1 | 11/2019 | Hughes |
| 2019/0362577 | A1 | 11/2019 | Vigil |
| 2020/0035050 | A1 | 1/2020 | Carter |
| 2020/0160263 | A1 | 5/2020 | Kuettner |
| 2020/0219340 | A1 | 7/2020 | Geerlings et al. |
| 2020/0231366 | A1 | 7/2020 | Vain et al. |

* cited by examiner

TAMPER EVIDENT DELIVERY PACKAGING

CROSS-REFERENCE TO RELATED APPLICATION

This application claims the benefit of priority of U.S. provisional application No. 62/989,748, filed Mar. 15, 2020, the contents of which are herein incorporated by reference.

BACKGROUND OF THE INVENTION

The present invention relates to food delivery services, and more particularly to packaging for food delivery services.

Most of all delivery services, and more specifically delivery of food, medication, groceries, wine, beer, alcohol and other regulated products, such as '21 and older products' are delivered in an unsecured fashion. These products and services are subject to being tampered with when transiting the delivery chain from merchants to consumers. For food products, it is important to protect the food from being exposed to adverse environmental and weather conditions.

It is known that many deliveries are tampered with—food deliveries are often tampered with and or eaten (tasted) or contaminated by the delivery person. Customers typically have no way of knowing that the delivered package is theirs and that the delivery is securely packaged at the merchant establishment and not tampered with during the delivery process.

As can be seen, there is a need for an improved tamper evident packaging that protects the product from being tampered with by the delivery person and or others from a point of initiation (merchant) to a point of receipt (the consumer).

SUMMARY OF THE INVENTION

In one aspect of the present invention, a tamper evident package is disclosed. The tamper evident packaging includes a plurality of sidewalls defining a package. The packaging has a closure providing access to an interior compartment of the packaging. A closure slide is configured to sealingly close a cooperating seal along the closure. The closure slide is operable between an open position, an intermediate position, and a fully closed position. One or more ratchet teeth are defined within the closure slide. The one or more ratchet teeth are oriented for cooperative engagement with one or more cooperating ratchet teeth on the closure to retain the closure slide in the fully closed position.

In some embodiments, a land is defined in a face of the closure slide. The land is adapted to carry a unique identification code. A window is defined in the closure at the fully closed position. Wherein, with the closure slide in the fully closed position, the unique identification code is visible through the window.

In some embodiments, an upper track is defined along a width of the closure. The upper track has at least one channel defined along the width of the closure and oriented inwardly from a first face of the closure. At least one protrusion is defined in as second face of the closure. The at least one protrusion extends along the width of the closure. The at least one protrusion is dimensioned for cooperative sealing engagement with the at least one channel.

In some embodiments, an upper slot is defined in the closure slide. The upper slot is dimensioned to urge the at least one protrusion in cooperative engagement with the at least one channel when the closure slide is moved from the open position towards the fully closed position.

In some embodiments, a lower track is defined across the closure and spaced apart from the upper track. The lower track has a keyed protrusion. A keyed slot is defined in the closure slide. The keyed slot and the keyed protrusion are configured to cooperatively engage as the closure slide is moved between the open position to the fully closed position to maintain the closure slide in alignment with the closure. The land may be disposed between the upper track and the lower track.

In other embodiments, the closure is formed of a frangible material to indicate a tamper event by one or more of a tearing, a marring, or a distortion of the frangible material.

In other aspects of the invention, a tamper evident package has a plurality of sidewalls defining a package. The packaging has a closure providing access to an interior compartment of the packaging. A closure slide is configured to sealingly close a cooperating seal along the closure. The closure slide is operable between an open position, an intermediate position, and a fully closed position. A land is defined in a face of the closure slide. The land is adapted to carry a unique identification code. A window is defined in the closure at the fully closed position. When in the fully closed position, the unique identification code is visible through the window.

In some embodiments, a plurality of ratchet teeth are defined within the closure slide. The plurality of ratchet teeth are oriented for cooperative engagement with a plurality of cooperating ratchet teeth at the fully closed end of the closure to retain the closure slide in the fully closed position.

In some embodiments, the closure includes an upper track that is defined along a width of the closure. The upper track has at least one channel defined along the width of the closure and oriented inwardly from a first face of the closure. A at least one protrusion in defined in a second face of the closure. The at least one protrusion extends along the width of the closure. The at least one protrusion is dimensioned for cooperative sealing engagement with the at least one channel.

In some embodiments, an upper slot is defined in the closure slide. The upper slot is dimensioned to urge the at least one protrusion in cooperative engagement with the at least one channel when the closure slide is moved from the open position towards the fully closed position.

In some embodiments, a lower track is defined across the closure and spaced apart from the upper track. The lower track has a keyed protrusion. A keyed slot is defined in the closure slide. The keyed slot and the keyed protrusion are configured to cooperatively engage as the closure slide is moved between the open position to the fully closed position to maintain the closure slide in alignment with the closure.

In some embodiments, the land is disposed between the upper track and the lower track.

In some embodiments, the closure is formed of a frangible material to indicate a tamper event by one or more of a tearing, a marring, or a distortion of the frangible material.

In yet other aspects of the invention, a tamper evident package includes a plurality of sidewalls defining a package. The packaging has a closure providing access to an interior compartment of the packaging. A closure slide is configured to sealingly close a cooperating seal along the closure. The closure slide is operable between an open position, an intermediate position, and a fully closed position. A slide lock is configured to retain the closure slide in the fully closed position. The slide lock includes one or more ratchet teeth carried within an upper slot of the closure slide and one or more cooperating ratchet teeth at a terminal end of the closure. A window is defined at a terminal end of the closure. A land on the closure slide is oriented such that the land is visible through the window when the closure slide is moved to the fully closed position.

In some embodiments, a unique identification code is carried on the land.

In some embodiments, a lower track is defined across the closure spaced apart from the upper track. The lower track has a keyed protrusion. A keyed slot is defined in the closure slide. The keyed slot and the keyed protrusion are configured to cooperatively engage as the closure slide is moved between the open position to the fully closed position to maintain the closure slide in alignment with the closure.

In some embodiments, the land is disposed between the upper track and the lower track.

In yet other embodiments, the closure is formed of a frangible material to indicate a tamper event by one or more of a tearing, a marring, or a distortion of the frangible material.

These and other features, aspects and advantages of the present invention will become better understood with reference to the following drawings, descriptions and claims.

DETAILED DESCRIPTION

The following detailed description is of the best currently contemplated modes of carrying out exemplary embodiments of the invention. The description is not to be taken in a limiting sense but is made merely for the purpose of illustrating the general principles of the invention.

Broadly, embodiments of the present invention provides a system, method, and apparatus for tamper evident delivery of products that is particularly adapted to delivery of food products. The tamper evident packaging of the present invention has integrated features that are described in the context of a food delivery service. This can be applied to other delivery applications such as medication, groceries, wine, beer, alcohol, and other regulated products, such as "21 and older products."

Figure 1:
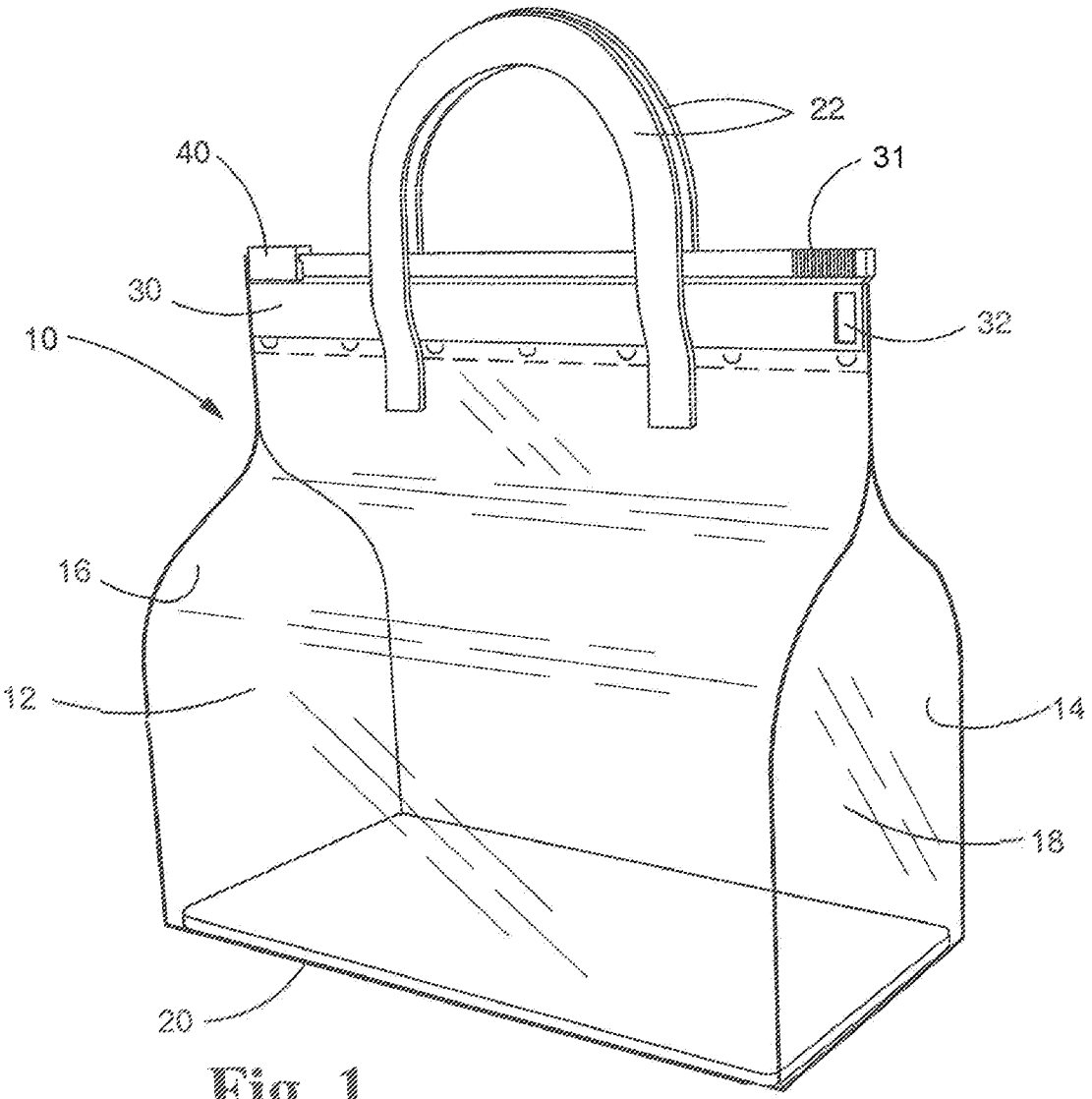
FIG. 1 is a side perspective view of the tamper evident delivery packaging.
Figure 2:
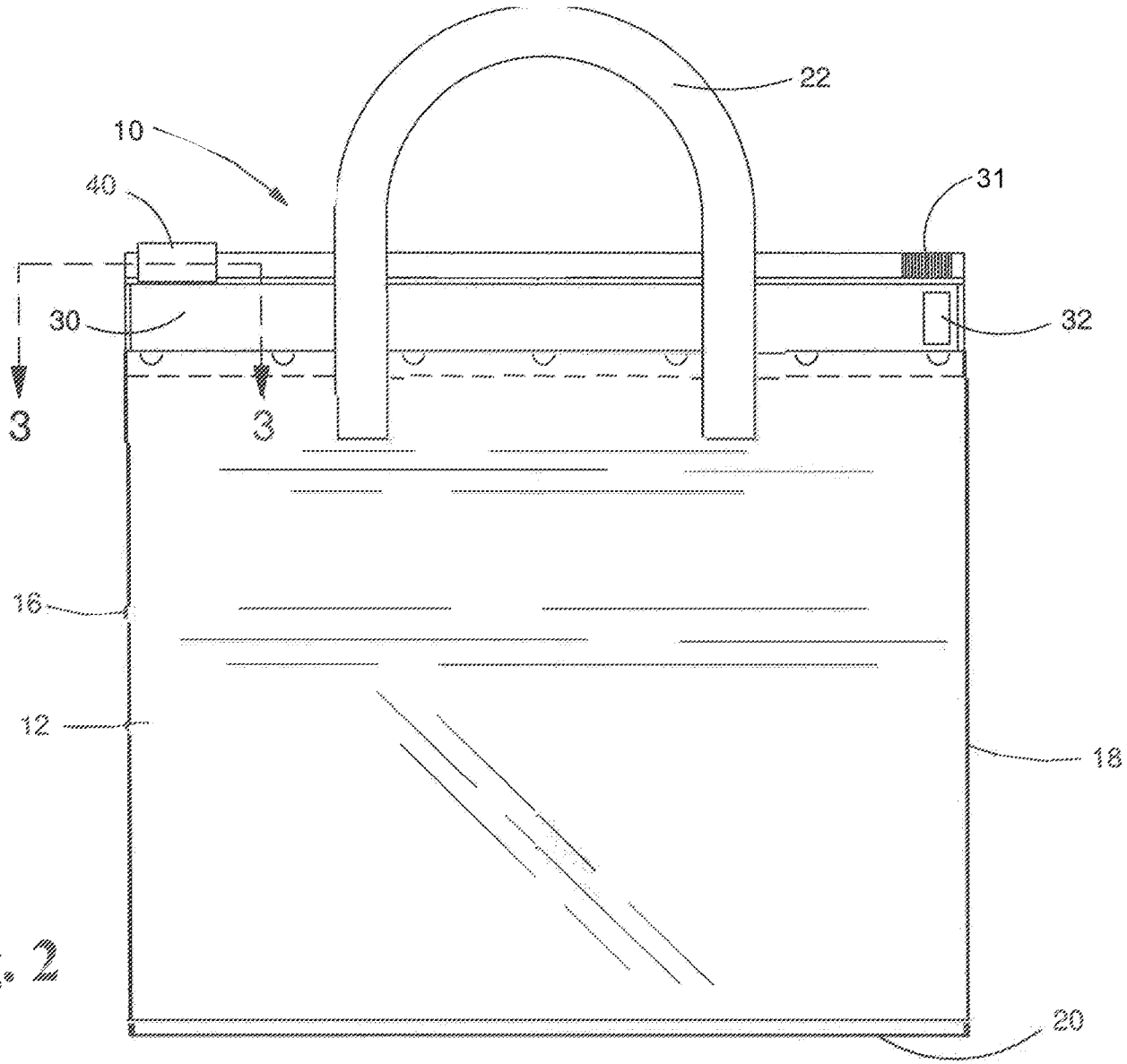
FIG. 2 is front elevation view of the tamper evident delivery packaging.
Figure 4:
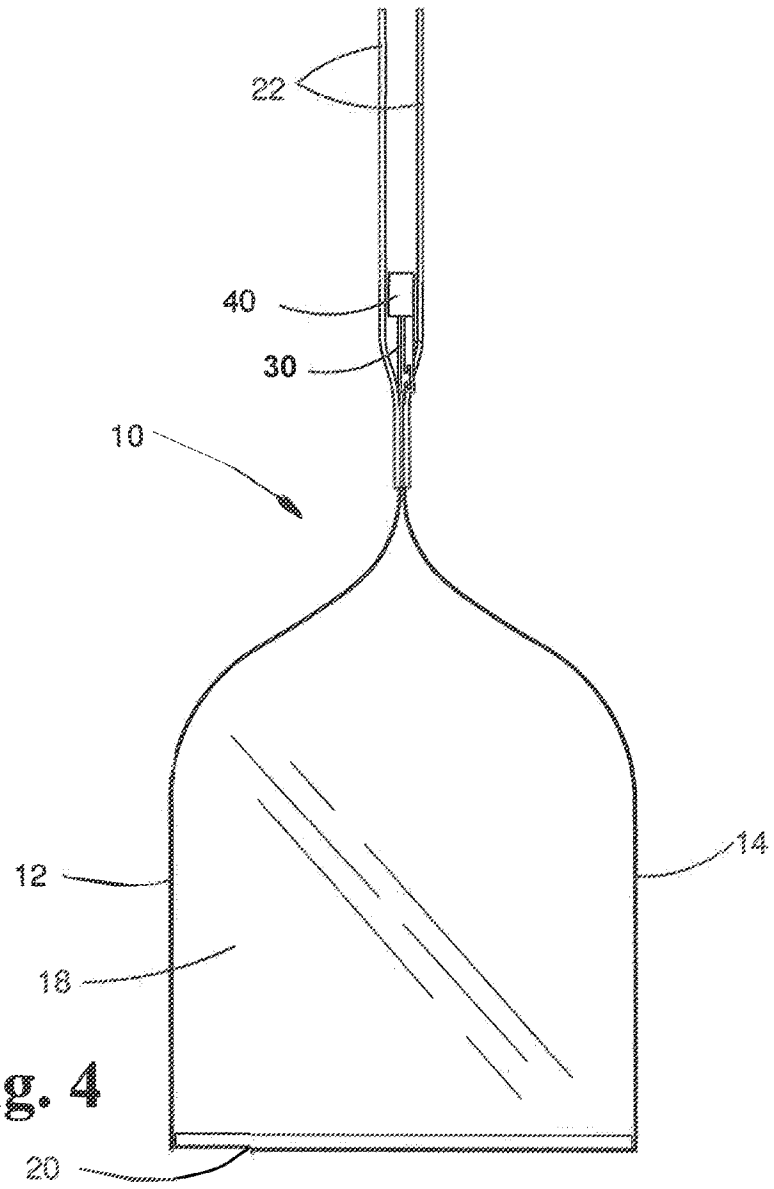
FIG. 4 is a side elevation view of the tamper evident delivery packaging.
Figure 3:
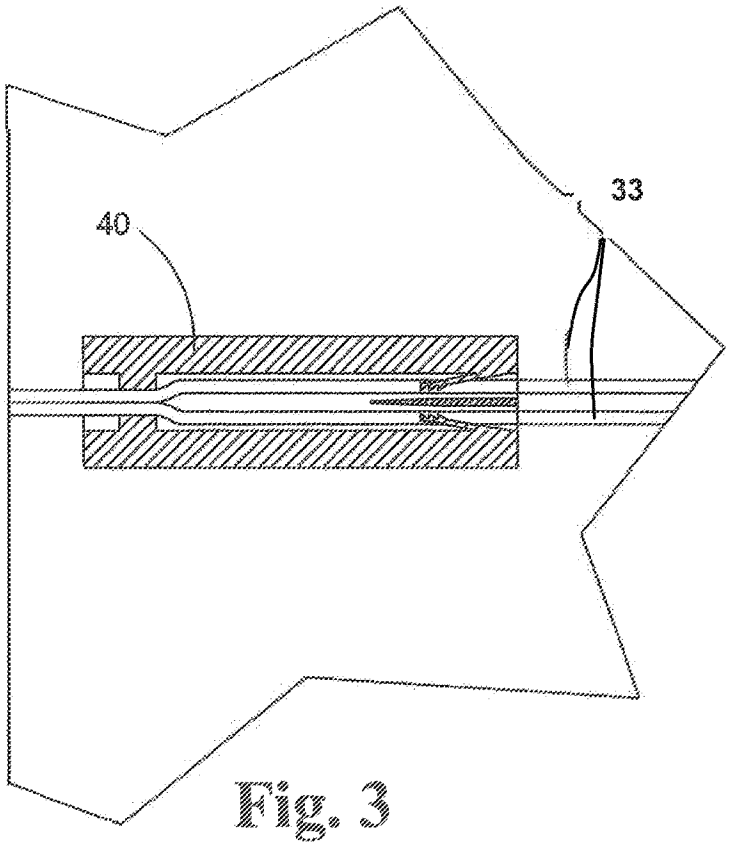
FIG. 3 is a top sectional view of a closure slide of the tamper evident delivery packaging taken along lines 3-3 of FIG. 2.
Figure 6:
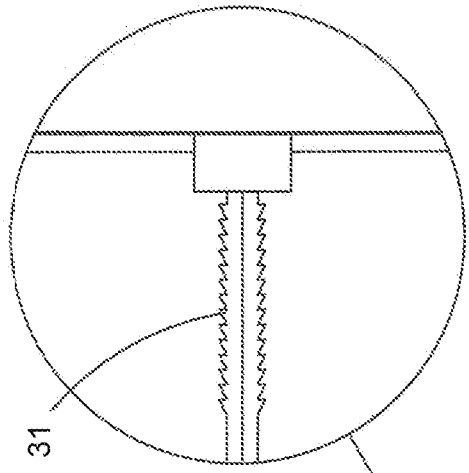
FIG. 6 is a detail view of a closure stop of the tamper evident delivery packaging.
Figure 5:
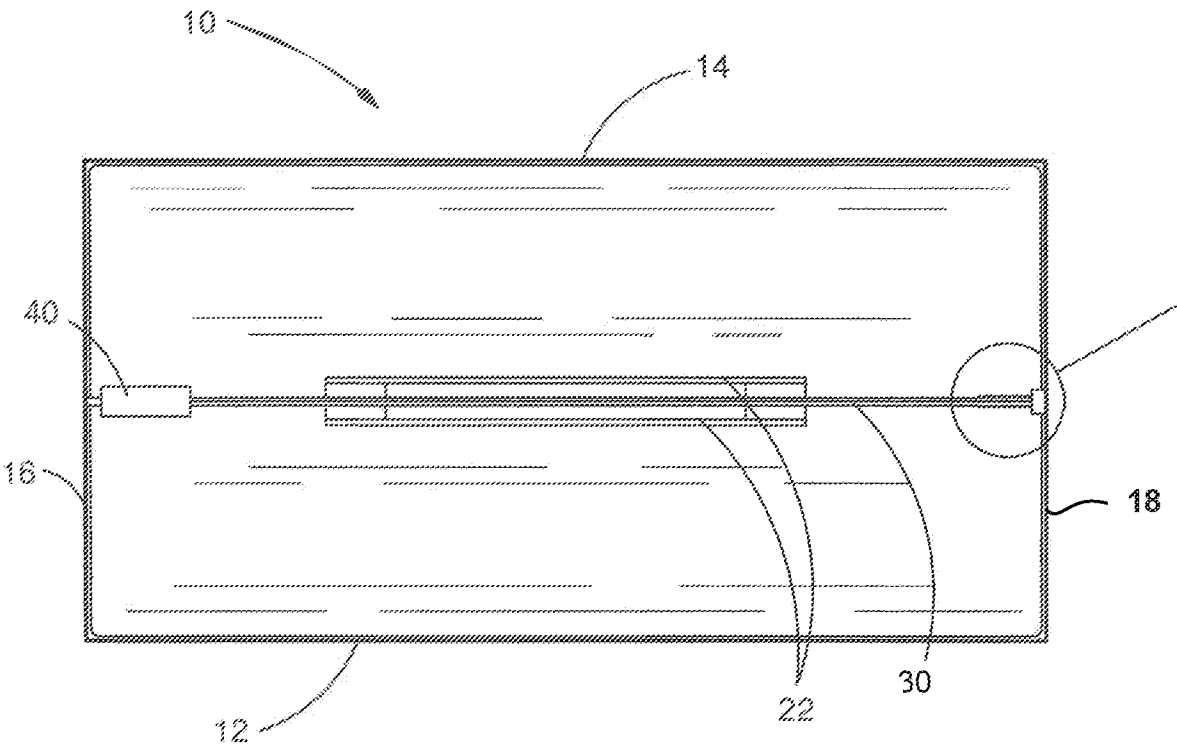
FIG. 5 is a top plan view of the tamper evident delivery packaging.
Figure 7:
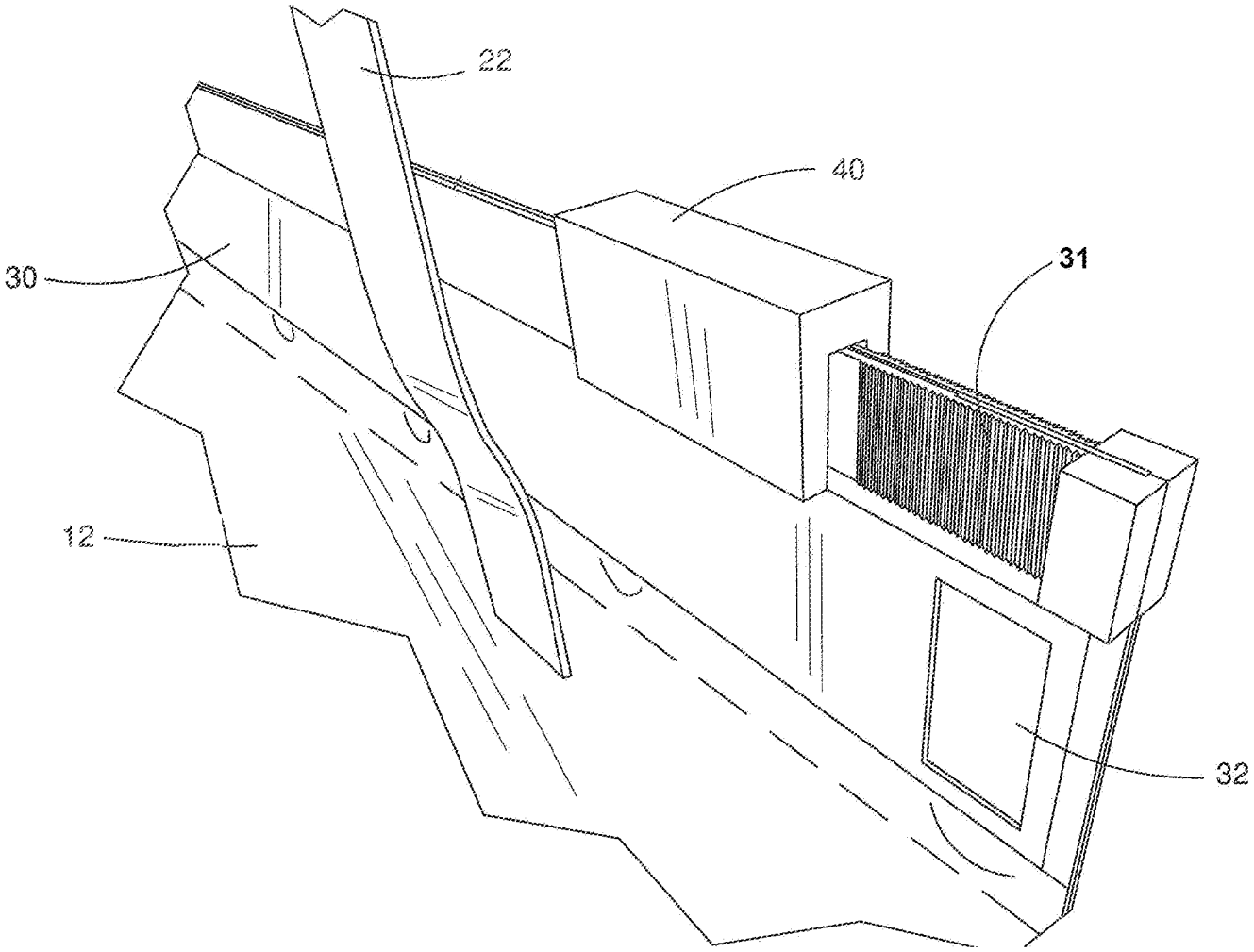
FIG. 7 is a partial front perspective view of the tamper evident delivery packaging in an intermediate closure condition.
Figure 8:
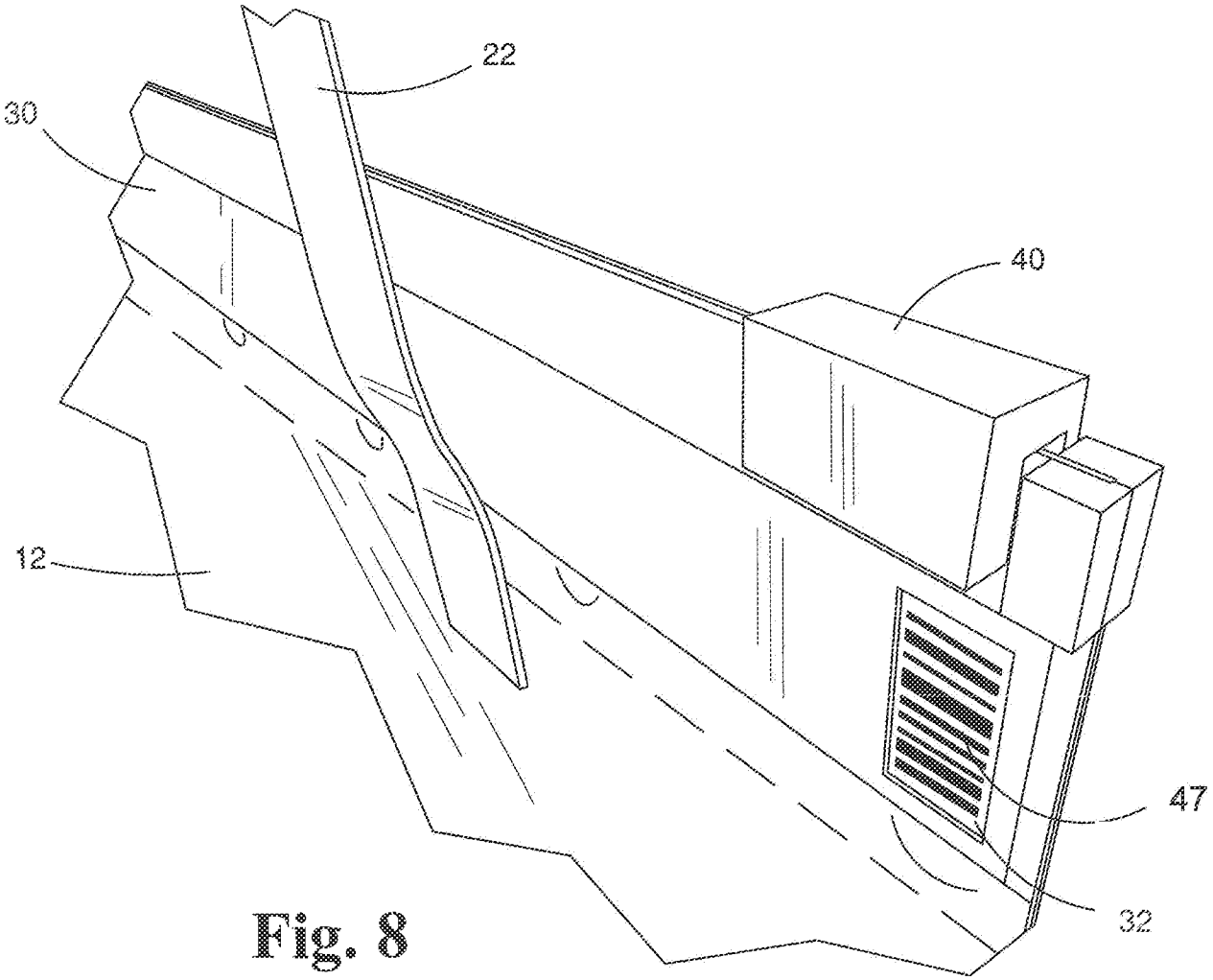
FIG. 8 is a partial front perspective view of the tamper evident delivery packaging in a closed condition.
Figure 9:
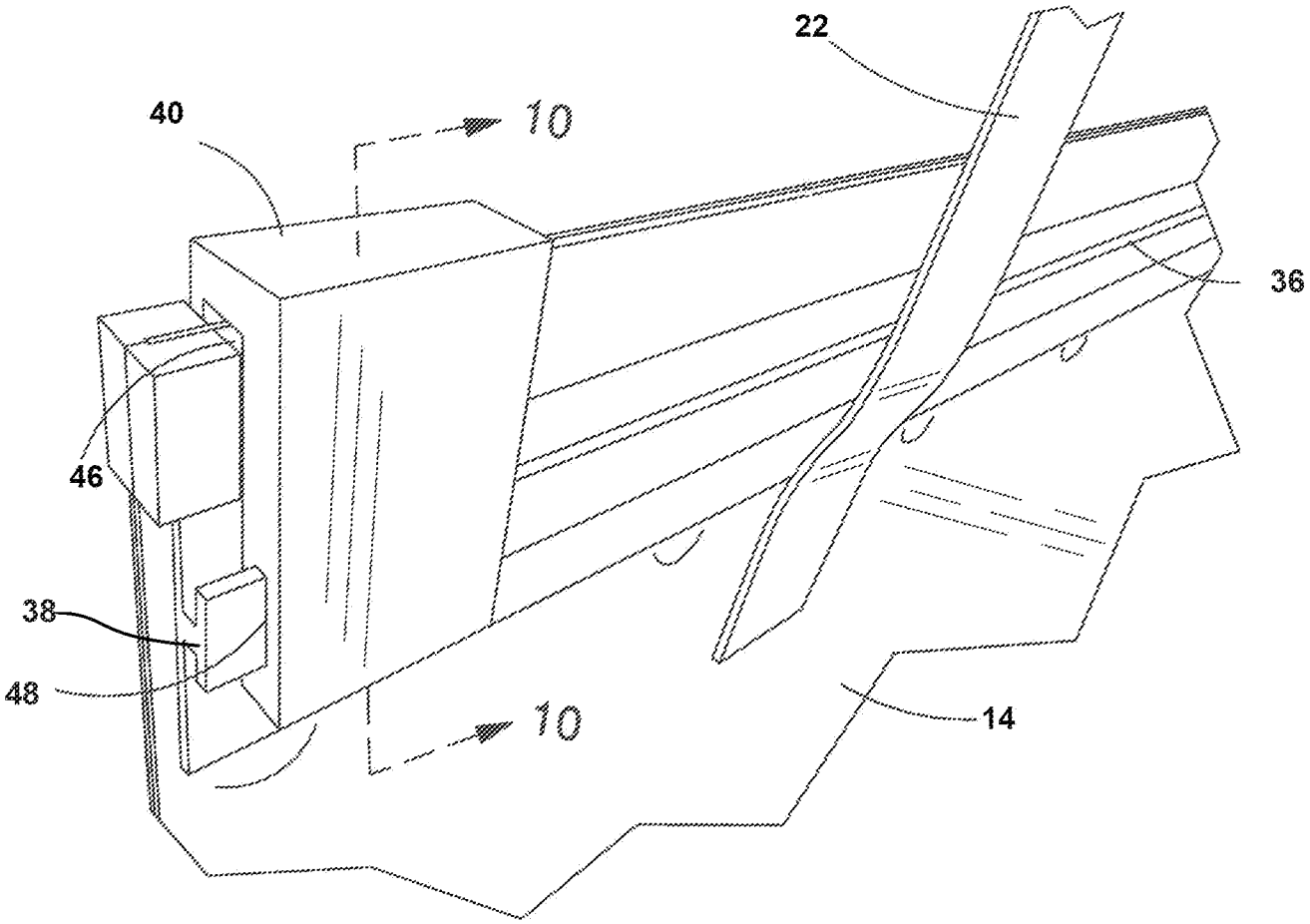
FIG. 9 is a partial rear perspective view of the tamper evident delivery packaging in a closed condition.
Figure 11:
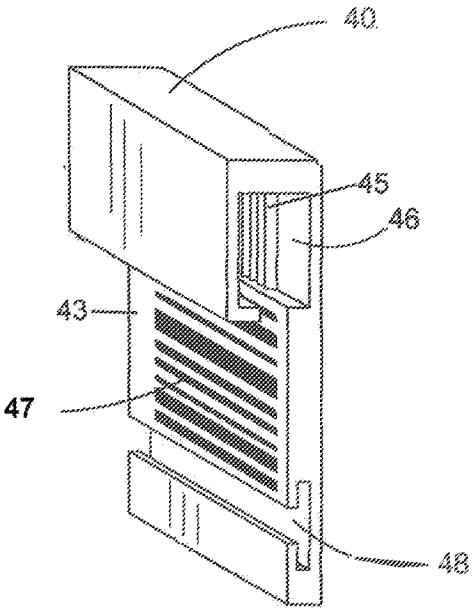
FIG. 11 is a side perspective view of a closure slide of the tamper evident delivery packaging.
Figure 10:
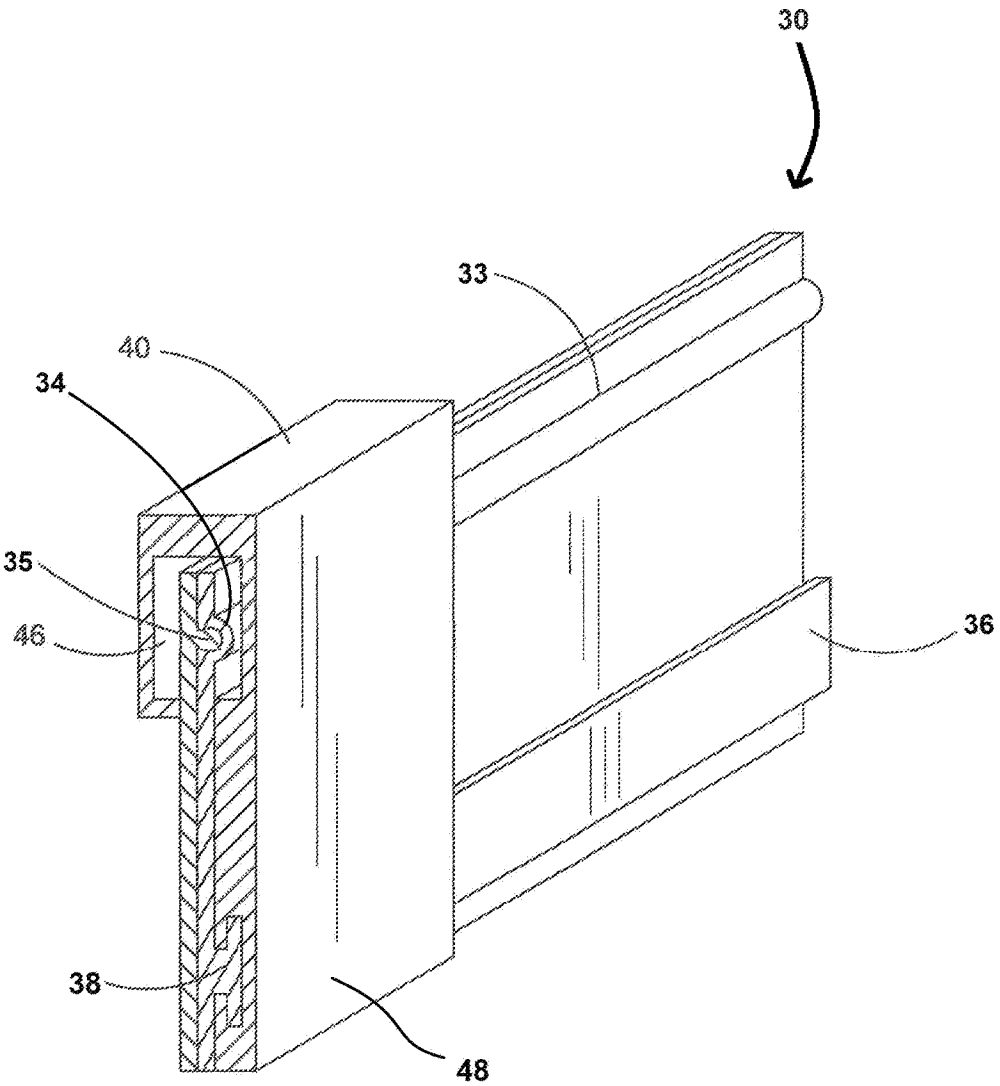
FIG. 10 is a partial side perspective sectional view of the tamper evident delivery packaging taken along lines 10-10 of FIG. 9.
Figure 14:
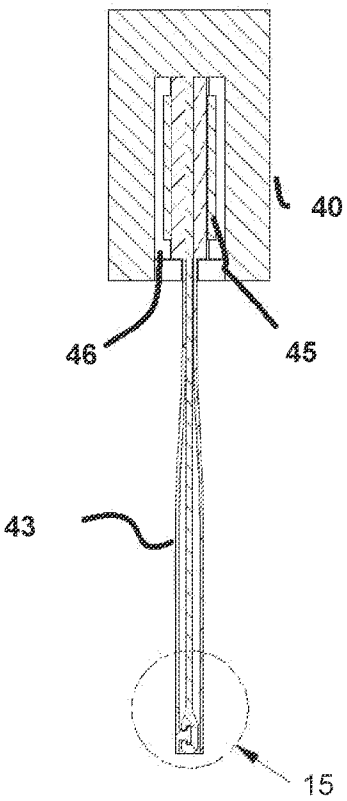
FIG. 14 is a side sectional view of the closure slide 40 taken along lines 14-14 of FIG. 13.
Figure 15:
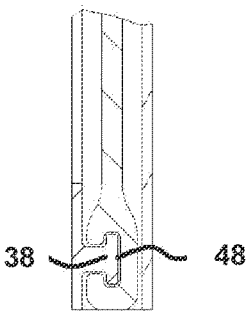
FIG. 15 is a detail view of the closure slide 40 taken at 15 of FIG. 14.
Figure 12:
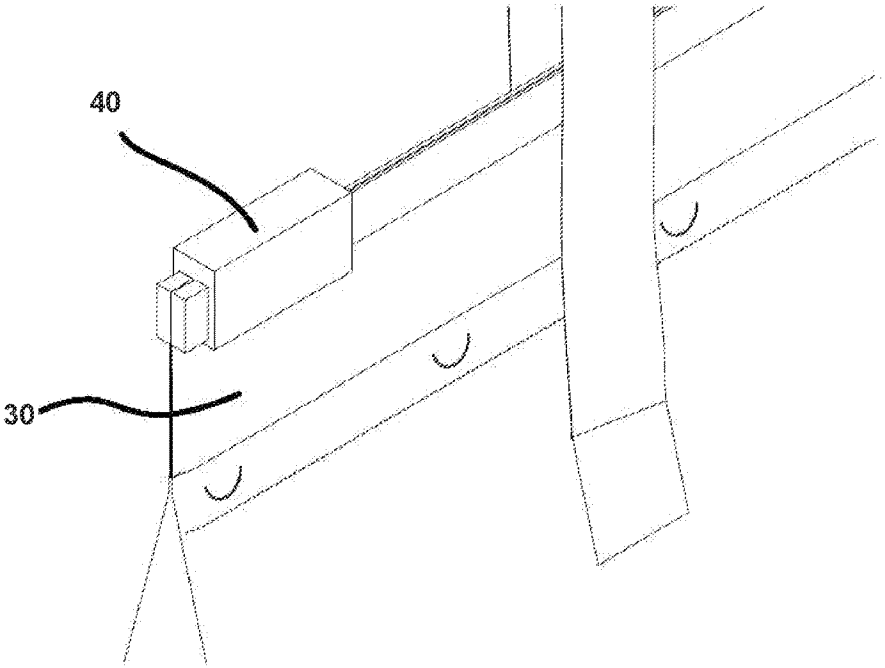
FIG. 12 is a partial rear perspective view of the tamper evident delivery packaging in a closed condition, showing an alternative embodiment of closure slide 40.
Figure 13:
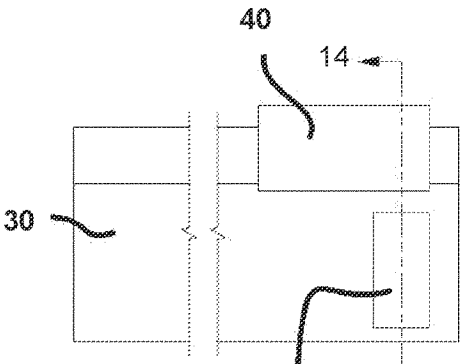
FIG. 13 is a detail front elevation view of the alternative embodiment of the closure slide 40 shown in FIG. 12.

Non-limiting embodiments of the present invention may be seen FIGS. 1-15 of the drawings. The tamper evident packaging 10 of the present invention has a plurality of walls defining a package and an interior compartment. The plurality of sidewalls may include a front wall 12, a rear wall 14, a left wall 16, a right wall 18 and a bottom wall 20. An opening is provided at a top end of the packaging providing access to the interior compartment. One or more handles 22 may be provided to facilitate carrying of the packaging. Preferably, the plurality of sidewalls are made of an opaque material to conceal the contents carried within the tamper evident packaging 10.

The tamper evident packaging 10 includes a closure 30 at the top end of the packaging. The closure 30 includes an upper track 33 and a lower track 36, both extending laterally across front and rear walls of closure 30 at a top end thereof.

The upper track 33 has at least one channel 34 defined along an inner face of the rear wall of closure 30. The upper track 33 has at least one protrusion 35 defined along an inner face of the front wall of closure 30, oriented for cooperative engagement with the at least one channel 34.

The tamper evident packaging 10 also includes a closure slide 40 having a first, or upper slot 46, that is dimensioned to receive the upper track 33, the channel 34, and the protrusion 35. The upper slot 46 is dimensioned to urge the channel 34 into cooperative engagement with the protrusion 35 as the closure slide 40 is moved along the closure 30 of the tamper evident packaging 10.

As seen in FIGS. 9, 10, 14, and 15, a lower track 36 is defined with a keyed protrusion 38 extending laterally across an outer face of the rear wall of closure 30. The-keyed protrusion 38 is dimensioned to be received within a corresponding keyed slot 48 of the closure slide 40. The keyed protrusion 38 and the keyed slot 48 are provided to retain the closure slide 40 with the tamper evident packaging 10 and indicate a tamper event by attempted removal of the closure slide 40. The lower track 36 also serves to retain the closure slide 40 in a vertical orientation as it is operated along the closure.

The upper slot 46 may have one or more ratchet teeth 45 disposed on an interior face of the upper slot 46. The one or more ratchet teeth 45 are oriented to engage with one or more cooperating ratchet teeth 31 defined along a closed end of the closure 30. The one or more ratchet teeth 45 and the plurality of cooperating ratchet teeth 31 engage to retain the closure slide 40 in the closed position and prevent the re-opening of the tamper evident packaging 10 once the closure slide 40 has been moved to the fully closed position. Attempted tamper events may be indicated by a tearing, a marring, or a distortion of one or more of the features defined herein.

A land 43 is disposed in between the upper slot 46 and the keyed slot 48. The land 43 is provided to carry a barcode 47, QR code, or other identifying indicia to uniquely identify the tamper evident packaging 10. A window 32 is provided at the closed end of the closure 30 such that the indicia is visible through the window 32 when the closure slide 40 is moved to the fully closed position. A window 32 may also be provided at the open position so that the indicia 47 is visible prior to loading contents into the tamper evident packaging 10.

In use, the contents are placed within the interior compartment of the tamper evident packaging 10. Once the contents are loaded, the closure slide 40 is operated from the first end to the second end of the closure 30. As the closure slide 40 is moved over the ratchet teeth 31 of closure 30, the interior ratchet teeth 45 of the upper slot 46 become cooperatively engaged until reaching a fully closed position, indicated by the identifying indicia 47 being visible through the window 32. The closure slide 40 is thereby locked in position to prevent tampering with the contents of the tamper evident packaging 10. If a tamper event is attempted one or more of the closure 30 or the closure slide 40 will be damaged, providing the recipient the ability to quickly detect the tampering event. The closure 30 or one or more sidewalls may also be formed of a frangible material to indicate a tampering event by one or more of a tearing, a marring, or a distortion of the frangible material.

The identifying indicia 47 may be used in many contexts. In the food service context, hereinafter called SafePlate, a consumer decides on ordering food or a product from a restaurant or a merchant to be delivered to them. The consumer places their order with the merchant. The consumer wants their order to be delivered through a tamper free secured means. The SafePlate Secured Delivery Platform provides the consumer this type of delivery protection.

An order flow is fulfilled electronically through The SafePlate Secured Delivery Platform, which receives the consumer's order electronically through a SafePlate Ordering Hub. Once a consumer places their order through The SafePlate Secured Delivery Platform the consumer receives a confirmation electronically (via email, phone and or text message). The confirmation contains a unique customer ordering number and a unique SafePlate security code, corresponding to the secured bar code 47.

The unique SafePlate security code allows the consumer to confirm their order from The SafePlate Secured Delivery packaging 10 upon receipt of their delivery and or allows the consumer to match their security code to the secured Bar-Coded tamper evident packaging 10 (ensuring to them that their order was not tampered with during the delivery process).

At the merchant end, the consumer's order is prepared for delivery by the restaurant or merchant. Upon completion the restaurant or merchant securely places the order into the SafePlate Secured Delivery packaging 10. Once the order contents are placed into the SafePlate Secured Delivery packaging 10 by the merchant, and the closure slide 40 is placed in the fully closed and locked position, the merchant scans the identifying indicia 47 of the SafePlate packaging 10, visible through the window 32.

The consumer's unique security code (or bar code) is automatically created and sent directly to the consumer via text, email and or voice mail. This SafePlate security code is unique to that delivery and to that consumer. The SafePlate security code is not published to the delivery person. This avoids the delivery person and or outsiders from gaining access to the contents of the SafePlate packaging 10.

As will be appreciated, the SafePlate Secured Delivery Platform also provides the consumer the ability to track their order online from start to finish. The consumer may be provided alerts and notifications via The SafePlate Secured Platform that their order was securely locked into The SafePlate packaging 10 by the restaurant or merchant. The delivery person delivers the order to the consumer. Upon arrival, the consumer uses their SafePlate unique security code 47 to confirm that the delivery corresponds to their order and retrieves their order (food delivery) or goods. When the consumer scans the identifying indicia 47 to confirm the delivery, the SafePlate platform may update the merchant with a delivery confirmation alert.

As described, the SafePlate Secured Delivery Platform allows for the merchant to securely lock the goods (food etc.) into The SafePlate packaging 10, track the delivery in transit, and receive a notification when the product is delivered to the consumer. Tampering events may be indicated by one or more of a tearing, a marring, or a distortion of the frangible material that is evident to the consumer upon delivery. The consumer may indicate the presence of the tampering event before or in conjunction with the scanning of the identifying indicia 47.

In some embodiments, the delivery service may utilize the identifying indicia 47 to indicate that an order is available for delivery, that the correct order has been picked up at the merchant and may also provide guidance instructions for the order.

The SafePlate Secured Delivery Platform may be utilized by consumers and merchants to securely deliver goods. Goods may be described as food delivery, grocery delivery, beer, wine, alcohol medication, and regulated products. The SafePlate Secured Delivery Platform protects the merchant and the consumer from their delivery being tampered with and from the environment.

It should be understood, of course, that the foregoing relates to exemplary embodiments of the invention and that modifications may be made without departing from the spirit and scope of the invention as set forth in the following claims.

What is claimed is:

1. A tamper evident package, comprising:

a plurality of sidewalls defining a packaging, the packaging having a closure providing access to an interior compartment of the packaging;

a closure slide configured to sealingly close a cooperating seal along the closure, the closure slide operable between an open position, an intermediate position, and a fully closed position;

one or more ratchet teeth defined within the closure slide, the one or more ratchet teeth oriented for cooperative engagement with one or more cooperating ratchet teeth to retain the closure slide in the fully closed position;

a land defined in a face of the closure slide, the land adapted to carry a unique identification code;

a window defined in the closure at the fully closed position, wherein with the closure slide in the fully closed position, the unique identification code is visible through the window;

an upper track defined along a width of the closure, the upper track having at least one channel defined along the width of the closure and oriented inwardly from a first face of the closure;

at least one protrusion defined in a second face of the closure, the at least one protrusion extending along the width of the closure, the at least one protrusion dimensioned for cooperative sealing engagement with the at least one channel;

an upper slot defined in the closure slide, the upper slot dimensioned to urge the at least one protrusion in cooperative engagement with the at least one channel when the closure slide is moved from the open position towards the fully closed position;

a lower track defined across the closure and spaced apart from the upper track, the lower track having a keyed protrusion; and a keyed slot defined in the closure slide, the keyed slot and the keyed protrusion configured to cooperatively engage as the closure slide is moved between the open position to the fully closed position to maintain the closure slide in alignment with the closure.

2. The tamper evident packaging of claim 1, wherein the land is disposed between the upper track and the lower track.

3. The tamper evident packaging of claim 2, wherein one or more of the closure, the closure slide, and the one or more sidewalls are formed of a frangible material to indicate a tamper event by one or more of a tearing, a marring, or a distortion of the frangible material.

4. A tamper evident package, comprising:

a plurality of sidewalls defining a packaging, the packaging having a closure providing access to an interior compartment of the packaging;

a closure slide configured to sealingly close a cooperating seal along the closure, the closure slide operable between an open position, an intermediate position, and a fully closed position;

a land defined in a face of the closure slide, the land adapted to carry a unique identification code;

a window defined in the closure at the fully closed position, wherein in the fully closed position, the unique identification code is visible through the window;

a plurality of ratchet teeth defined within the closure slide, the plurality of ratchet teeth oriented for cooperative engagement with a plurality of cooperating ratchet teeth at the fully closed end of the closure to retain the closure slide in the fully closed position;

an upper track defined along a width of the closure, the upper track having at least one channel defined along the width of the closure and oriented inwardly from a first face of the closure;

at least one protrusion defined in a-second face of the closure, the at least one protrusion extending along the width of the closure, the at least one protrusion dimensioned for cooperative sealing engagement with the at least one channel;

an upper slot defined in the closure slide, the upper slot dimensioned to urge the at least one protrusion in cooperative engagement with the at least one channel when the closure slide is moved from the open position towards the fully closed position;

a lower track defined across the closure spaced apart from the upper track, the lower track having a keyed protrusion; and a keyed slot defined in the closure slide, the keyed slot and the keyed protrusion configured to cooperatively engage as the closure slide is moved between the open position to the fully closed position to maintain the closure slide in alignment with the closure.

5. The tamper evident package of claim 4, wherein the land is disposed between the upper track and the lower track.

6. The tamper evident package of claim 5, wherein at least one of the closure, the closure slide, and the one or more sidewalls are formed of a frangible material to indicate a tamper event by one or more of a tearing, a marring, or a distortion of the frangible material.

7. A tamper evident package, comprising:

a plurality of sidewalls defining a packaging, the packaging having a closure providing access to an interior compartment of the packaging;

a closure slide configured to sealingly close a cooperating seal along the closure, the closure slide operable between an open position, an intermediate position, and a fully closed position;

a slide lock configured to retain the closure slide in the fully closed position, the slide lock comprising one or more ratchet teeth carried within an upper slot of the closure slide and one or more cooperating ratchet teeth at a terminal end of the closure;

a window defined at a terminal end of the closure;

a land on the closure slide, the land visible through the window when the closure slide is moved to the fully closed position;

a lower track defined across the closure spaced apart from the upper track, the lower track having a keyed protrusion; and a keyed slot defined in the closure slide, the keyed slot and the keyed protrusion configured to cooperatively engage as the closure slide is moved between the open position to the closed position to maintain the closure slide in alignment with the closure.

8. The tamper evident package of claim 7, further comprising:

a unique identification code carried on the land.

9. The tamper evident package of claim 7, wherein the land is disposed between the upper track and the lower track.

10. The tamper evident package of claim 7, wherein at least one of the closure, the closure slide, and the one or more sidewalls are formed of a frangible material to indicate a tamper event by one or more of a tearing, a marring, or a distortion of the frangible material.

* * * * *